United States Patent [19]

Reynolds

[11] Patent Number: 4,853,109

[45] Date of Patent: Aug. 1, 1989

[54] DEMETALATION OF HYDROCARBONACEOUS FEEDSTOCKS USING DIBASIC CARBOXYLIC ACIDS AND SALTS THEREOF

[75] Inventor: John G. Reynolds, El Cerrito, Calif.

[73] Assignee: Chevron Research Company, San Francisco, Calif.

[21] Appl. No.: 164,597

[22] Filed: Mar. 7, 1988

[51] Int. Cl.[4] ..... C10G 17/00

[52] U.S. Cl. ..... 208/252; 208/251 R; 208/309; 423/155; 423/165; 585/866

[58] Field of Search ..... 208/252, 251 R; 585/866; 423/155, 165

[56] References Cited

U.S. PATENT DOCUMENTS

| | | | |
|---|---|---|---|
| 2,739,103 | 3/1956 | Thompson | 208/252 |
| 2,744,853 | 5/1956 | Kavanagh | 208/252 |
| 2,767,123 | 10/1956 | Hickok et al. | 208/252 |

*Primary Examiner*—H. M. S. Sneed
*Assistant Examiner*—Helane Myers
*Attorney, Agent, or Firm*—T. G. De Jonghe; Q. T. Dickinson

[57] ABSTRACT

Dibasic carboxylic acids or salts thereof are used to remove metals, particularly calcium and iron, from hydrocarbonaceous feedstocks. An aqueous solution of the acid is used to extract the metals from the feedstock prior to processing. Oxalic acid is the preferred compound.

13 Claims, No Drawings

DEMETALATION OF HYDROCARBONACEOUS FEEDSTOCKS USING DIBASIC CARBOXYLIC ACIDS AND SALTS THEREOF

BACKGROUND OF THE INVENTION

This invention relates to a process for the removal of metals, particularly calcium and iron, from metals-containing petroleum crudes or heavy hydrocarbonaceous residua using oxalic acid as a sequestering or chelating agent. A few, but increasingly important, petroleum crude feedstocks, residua, and deasphalted oil derived from them, contain levels of calcium or iron which render them difficult, if not impossible, to process using conventional refining techniques. The metals contaminants causing particular problems are in the form of non-porphyrin, organometallically-bound compounds. These species have been attributed to either naturally occurring calcium or iron complexes or solubilized calcium from recovery waters which comes in contact with crude oils, or solubilized iron from corrosion and decay of iron-bearing equipment which comes in contact with crude oils. One possible class of calcium or iron-containing compounds identified in particular is the respective naphthenates and their homologous series. These organometallic compounds are not separated from the feedstock by normal desalting processes, and in a conventional refining technique they can cause the very rapid deactivation of hydroprocessing catalysts. Examples of feedstocks demonstrating objectionably high levels of calcium compounds are crudes from China such as Shengli No. 2; examples of high iron-containing crudes include those from San Joaquin Valley in California, generally contained in a pipeline mixture referred to as San Joaquin Valley crude or residuum.

The problems presented by calcium and iron in petroleum feedstocks and the necessity for their removal having only been recently appreciated, and the prior art contains few references specifically to their removal. Metals removal generally using organic compounds, however, has been addressed in the prior art, specifically for the removal of known metallic contaminants, such as nickel, vanadium, and/or copper. The compounds are also ordinarily found in feedstocks as porphyrins and other organometallic compounds.

In U.S. Pat. No. 3,052,627, Lerner, metals-contaminants are removed from crude petroleum feedstocks using a 2-pyrrolidone-alcohol mixture. In U.S. Pat. No. 3,167,500, Payne, metallic contaminants, such as metal-containing porphyrins, are removed from petroleum oils using a condensed polynuclear aromatic compound having a preferred C/H ratio and a molecular weight ordinarily called pitch binders. In U.S. Pat. No. 3,153,623, Eldib et al, selected commercially available organic compounds of high dielectric strength were added to assist in a process basically encompassing the electrically-directed precipitation of metals. U.S. Pat. No. 4,439,345, Duke, discloses the use of carboxylic acids to demulsify by demetalation the middle phase emulsion of an enhanced oil recovery product.

Among other factors, it has now been unexpectedly found that the metals-containing contaminants, particularly those containing calcium and iron, may be effectively removed from the feedstocks of the present invention by binding the metal compounds using oxalic acid and its salts.

SUMMARY OF THE INVENTION

The process comprises of a method for demetalating hydrocarbonaceous feedstocks, particularly crude petroleum or residua using an aqueous solution of the chelating agent. The method is particularly appropriate for removing calcium and iron, especially non-porphyrin, organically-bound calcium or iron compounds. The preferred metal chelating agents are the dibasic carboxylic acids, such as oxalic acid and salts thereof in an aqueous solution. In the preferred process, the feedstock to be demetallized is intimately and thoroughly mixed with an aqueous solution of the oxalic acid and its salts. The metals complex with the agent; the resulting complex being extracted into the aqueous phase. The aqueous phase and the hydrocarbon phase are separated and the hydrocarbonaceous feedstock is then available for hydroprocessing.

DETAILED DESCRIPTION OF THE INVENTION

Various petroleum crude feedstocks and residua produced from them contain unacceptably high levels of calcium or iron-containing metals contaminants. These metallic ions, especially organically bound, or calcium or iron-containing compounds cause distinct processing difficulties in standard hydroprocessing techniques, ordinarily by rapid deactivation or fouling of the hydroprocessing catalyst. This invention comprises a method for removing those metals-containing contaminants prior to hydroprocessing of the crude or residua by using a chelating agent or agents, dibasic carboxylic acids and salts thereof.

The invention can be applied to any hydrocarbonaceous feedstock containing an uacceptably high level of calcium or iron. Those feedstocks can include crude petroleum, especially from particular sources, such as San Joaquin Valley crude, including, for example, South Belridge, Kern Front, Cymric Heavy, Midway Sunset, or Shengli from China or mixtures thereof. Additionally, atmospheric or vacuum residua or solvent deasphalted oils derived from these crudes, also can have unacceptably high calcium or iron levels. It is within the contemplation of the invention that any other hydrocarbonaceous feedstocks, such as shale oil, liquefied coal, beneficiated tar sand, etc., which may also contain similar metals contaminants, may be processed using this invention.

The basic process is relatively simple: The crude, residuum or deasphalted oil to be processed is mixed with an aqueous solution of the dibasic carboxylic acid or salts thereof, and a base for adjusting the pH above 2, and preferably between 5 to 9. The calcium or iron is readily bound or chelated to the acid ion to form a complex. This metal-dibasic-carboxylic acid complex is ionic and water-soluble, and is therefore extracted into the aqueous phase of the mixture. The two phases, the aqueous and the crude or hydrocarbonaceous phases, are separated or permitted to separate. The aqueous solution containing the calcium or iron contaminant is removed, resulting in a metals-free hydrocarbon feed which then can be handled in the same manner as any other carbonaceous feed and processed by conventional hydroprocessing techniques. It is contemplated that the physical separation process is ordinarily to be done in a conventional crude desalter, which is usually used for desalting petroleum crudes prior to hydroprocessing.

The separation may be done by any separation process, however, and may include countercurrent extraction.

It is well known that the dibasic carboxylic acids have a high affinity for calcium, iron and other metal ions. Known as chelating agents, a common example of these dibasic carboxylic acids is: oxalic acid—$C_2H_2O_4$; molecular weight 90.04, known also as ethanedioic acid.

Other dibasic carboxylic acids which should have comparable activity toward calcium and iron are, for example, malonic acid, succinic acid, maleic acid, and adipic acid. These acids all exhibit polyfunctionality like oxalic acid which partially accounts for their chelation ability toward calcium and iron.

Dibasic carboxylic acids, and oxalic acid in particular, are members of a broad class of multidentate chelating ligands which complex or coordinate metal ions. These compounds form very stable metal ligand complexes. Oxalic acid is ordinarily used to remove rust and corrosion in cooling systems; to remove paint, varnish, or ink stains.

These dibasic carboxylic ligands form complexes with calcium and iron ions which are stable and can be isolated. They are also water soluble, allowing for their separation from hydrophobic phases. Oxalic acid and its salts will complex other metal ions in aqueous solution but appear to have little or no effect on the more commonly found, ordinary organometallic metal contaminants in petroleum, such as nickel and vanadium petroporphyrins.

The salt forms of oxalic acid can be generally formed in situ by the addition of most any strong base, and can be isolated in some cases, from the aqueous solution as crystalline salts. The salts are generally more water soluble, and less acidic than the free acids.

As discussed previously, in order for the metal to bind appropriately to the oxalic acid, the pH should be above 2, and preferably 5 to 9. One difficulty with the addition of base, however, is the formation of emulsions. Therefore, the most preferred pH is 6, especially with naphthenic acid crudes.

The ratio of aqueous oxalic acid solution to hydrocarbonaceous feed should be optimized, with the determining factor being the separation method. Commercial desalters, for example, ordinarily run at 10% or less aqueous volume. Countercurrent extraction may also be used for separation. Effective separations have been done at 50% or more aqueous volume.

The contact time between the aqueous extraction solution and the hydrocarbonaceous feed is important, and may vary from between a few seconds to about 4 hours. The preferred contact time is from about 10 seconds to 1 hour.

EXAMPLES

In laboratory trials—the results of which are detailed in the tables below—the amount of oil to be treated was dissolved in toluene, if necessary, to give a workable viscosity, and was mixed with 50% aqueous volume of the oxalic acid solution. The solution was prepared by dissolving the appropriate amount of the oxalic acid in deionized $H_2O$ to give the specific mole equivalents of agent to moles of calcium or iron, and the pH was adjusted to 6 with ammonium hydroxide. A demulsifier, named Treatolite L-1562,was added. The oxalic acid solution and the oil mixture were shaken or mixed and allowed to separate, preferably overnight. The residuum was analyzed before and after treatment to determine the amount of calcium or iron removed.

CALCIUM EXAMPLES

Example 1

San Joaquin Valley (SJV) vacuum residuum (93 ppm Ca) and Shengli No. 2 crude (49 ppm Ca) were treated with oxalic acid. Table I indicates mole equivalence levels as low as 2 to 1 are all that are necessary for high calcium removal.

TABLE I

| Feed | Mole Ratio | Reaction Time | % Ca Removal |
|---|---|---|---|
| SJV | 2 | 15 min | 94 |
| Shengli | 2 | 15 min | 90 |
| Shengli | 3 | 15 min | 90 |
| Shengli | 5 | 15 min | 90 |

IRON EXAMPLES

Example 2

Deasphalted oil from heavy residua (15 ppm Fe) was treated. Table II indicates mole equivalent dependency for iron removal. Mole equivalence levels as low as 1 to 1 are all that are necessary for high iron removal.

TABLE II

| Mole Agent/Mole Fe | Reaction Time | % Fe Removal |
|---|---|---|
| 6 | 15 min | 73 |
| 3 | 15 min | 67 |
| 1 | 15 min | 67 |

Example 3

Shengli No. 2 crude from China (13 ppm iron) was treated for iron removal and the results are listed in Table III. Mole equivalence as low as 2 to 1 was all that was necessary to achieve high iron removal. Citric acid was also used for comparison.

TABLE III

| Mole Agent/Mole Fe | Reaction Time | % Fe Removal |
|---|---|---|
| 2 (oxalic) | 15 min | 77 |
| 3 (oxalic) | 15 min | 77 |
| 5 (oxalic) | 15 min | 77 |
| 5 (oxalic) | 15 sec | 75 |
| 5 (citric) | 15 sec | 54 |

What is claimed is:

1. A method for demetalizing Group IIA and/or Group VIII metals from hydrocarbonaceous feedstock comprising:

mixing said hydrocarbonaceous feedstock with an aqueous solution of a metals sequestering agent, said agent comprising dibasic carboxylic acid or salts thereof; and separating the substantially demetalated hydrocarbonaceous feedstock from the aqueous solution; wherein the feedstock to be demetalated is selected from the group consisting of crude petroleum, atmospheric or vacuum residua, solvent deasphalted oil derived from these crudes or residua, shale oil, liquefied coal, and tar sand effluent.

2. The method as claimed in claim 1 wherein the metal is calcium.

3. The method as claimed in claim 1 wherein the metal is iron.

4. The method as claimed in claim 1 wherein the metals are organometallically-bound, non-porphyrin compounds.

5. The method as claimed in claim 4 wherein the compounds are compounds of calcium.

6. The method as claimed in claim 4 wherein the compounds are compounds of iron.

7. The method as claimed in claim 1, wherein said metals sequestering agents comprise oxalic acid and salts thereof.

8. The method as claimed in claim 4 wherein said metals sequestering agents comprise oxalic acid and salts thereof.

9. The method as claimed in claim 7 wherein the pH of the mixing step is adjusted to 2 or above.

10. The method as claimed in claim 9 wherein the pH of the mixing step is adjusted to 5 or above.

11. The method as claimed in claim 7 wherein the mixing time is 10 seconds or more.

12. The method as claimed in claim 11 wherein the mixing time is 15 minutes.

13. The method as claimed in claim 1 wherein said separating is performed by a desalting process or countercurrent extraction.

* * * * *